United States Patent [19]

Osborne et al.

[11] 4,040,045

[45] Aug. 2, 1977

455/3

[54] METHOD AND APPARATUS FOR CREATING AND DETECTING ALARM CONDITION USING A MASTER ANTENNA TELEVISION SYSTEM

[76] Inventors: Richard C. Osborne, 505 Nottingham, Richardson, Tex. 75080; Richard L. Bickel, 9257 Meadowglen, Dallas, Tex. 75238

[21] Appl. No.: 580,611

[22] Filed: May 27, 1975

[51] Int. Cl.[2] ..... G08B 13/22

[52] U.S. Cl. ..... 340/280; 325/308; 340/216; 340/310 R

[58] Field of Search ..... 340/280, 216, 310 R, 340/256, 253 A, 253 B; 325/31, 308; 178/DIG. 13; 323/8

[56] References Cited

U.S. PATENT DOCUMENTS

| | | | |
|---|---|---|---|
| 3,135,951 | 6/1964 | Byrne | 340/310 R |
| 3,289,194 | 11/1966 | King | 340/256 |
| 3,346,798 | 10/1967 | Dinger | 323/8 |
| 3,407,400 | 10/1968 | Lurie | 340/280 |
| 3,408,643 | 10/1968 | Sliman | 340/280 |
| 3,439,359 | 4/1969 | Sliman | 340/280 |
| 3,544,984 | 12/1970 | Hanson | 340/280 |
| 3,618,065 | 11/1971 | Trip et al. | 340/280 |
| 3,766,540 | 10/1973 | Schopfer et al. | 340/280 |
| 3,784,930 | 1/1974 | Vosteen et al. | 323/8 |
| 3,886,538 | 5/1975 | Takeuchi | 340/216 |
| 3,974,492 | 8/1976 | Girismen | 340/280 |

*Primary Examiner*—Glen R. Swann, III
*Attorney, Agent, or Firm*—Robert W. Turner

[57] ABSTRACT

A method and apparatus for detecting theft of television sets from motels and similar establishments which provide unattended television sets and service as a convenience for customers. The invention uses existing trunk lines utilized in a master antenna television system (MATV) for transmitting television signals to the sets, and does not require installation of additional conductors. A source of low 60 Hertz voltage is applied to each of the trunk lines, and there is associated with each television set a resistor. When the connection of a set to a trunk line is disturbed, the disturbance is detected as a change in resistance and the level of 60 Hz current flowing through the trunk line is caused to change. This change in current is detected at a central location to create an alarm condition. An audible alarm is also created at the location of the television set which was disturbed.

13 Claims, 7 Drawing Figures

METHOD AND APPARATUS FOR CREATING AND DETECTING ALARM CONDITION USING A MASTER ANTENNA TELEVISION SYSTEM

BACKGROUND OF THE INVENTION

The present invention relates to alarm systems, and more particularly to an alarm system adapted for use with a master antenna television system.

Many establishments, such as motels, hotels and hospitals, have master antenna television systems which utilize a single antenna or single connection to a cable antenna system for the purpose of distributing television and radio frequency signals to a plurality of rooms which are equipped with individual television sets. Such systems will typically include one or more trunk lines which derive signals from a main cable using splitters. Power available from a single splitter will normally provide signals to approximately 10 or 15 television sets. Thus, in very large motels or hotels there will normally be a large number of trunk lines, with the sets attached to a particular trunk line being located within a relatively small area. For example, one trunk line may serve the television sets positioned in rooms within one floor of one wing of a motel.

The value of television sets stolen from such establishments, and particularly motels, numbers in the millions of dollars each year. Many thefts occur in situations in which personnel of the establishment being robbed are aware of the occurrence of the theft, but feel powerless to stop the act of thievery because they do not wish to confront the thief.

Various systems have been devised for the purpose of attempting to alert personnel to the occurrence of a theft. Generally, however, such systems have utilized a system of wiring completely separate and apart from the MATV system or, as in the case of U.S. Pat. No. 3,696,378, attempted to use the MATV System as part of a continuous loop system in which the lack of voltage is detected for signaling an alarm condition.

SUMMARY OF THE INVENTION

The present invention provides an improved alarm system especially adapted for use with master antenna TV systems. In accordance with the principles of the present invention, a source of low voltage 60 Hz power is applied to each trunk line of the system. There is associated with each tap located along the trunk line an alarm detecting circuit which produces a change in the current flowing through the trunk line when an occurrence is detected which justifies an alarm signal. The change in current flowing through the trunk line is detected at a central point, and suitable alarm devices are actuated. In accordance with the preferred embodiment of the invention, a specified range of resistance must be maintained between the signal bearing line leading from the tap to the television set and ground. If this value of resistance is disturbed either by creating a partial short circuit or open circuit, an alarm condition will be created. Preferably, an audible alarm is actuated both at the central point, for calling attention of personnel to the alarm condition, and at the location of the tap to facilitate location of the position along the trunk line at which the alarm signal was created. Provision of an audible warning at both locations is desirable in that it prevents occurrence of a dangerous situation in which personnel confront a surprised thief. It also permits a guest who inadvertently causes an alarm to be created to notify the motel personnel of the error and thus prevent a false arrest. There is also provided an improved regulated voltage supply circuit which protects the system against both excessive current and excessive voltage, along with a tamper-proof adapter for connecting conventional television sets to a directional tap in a manner as to make disconnection of the television from the tap virtually impossible without creating an alarm condition.

BRIEF DESCRIPTION OF THE DRAWINGS

Many objects and advantages of the invention will become apparent to those skilled in the art as a detailed description of the preferred embodiment of the invention unfolds in conjunction with the appended drawings wherein like reference numerals denote like parts and in which.

DESCRIPTION OF THE PREFERRED EMBODIMENT

Figure 1:
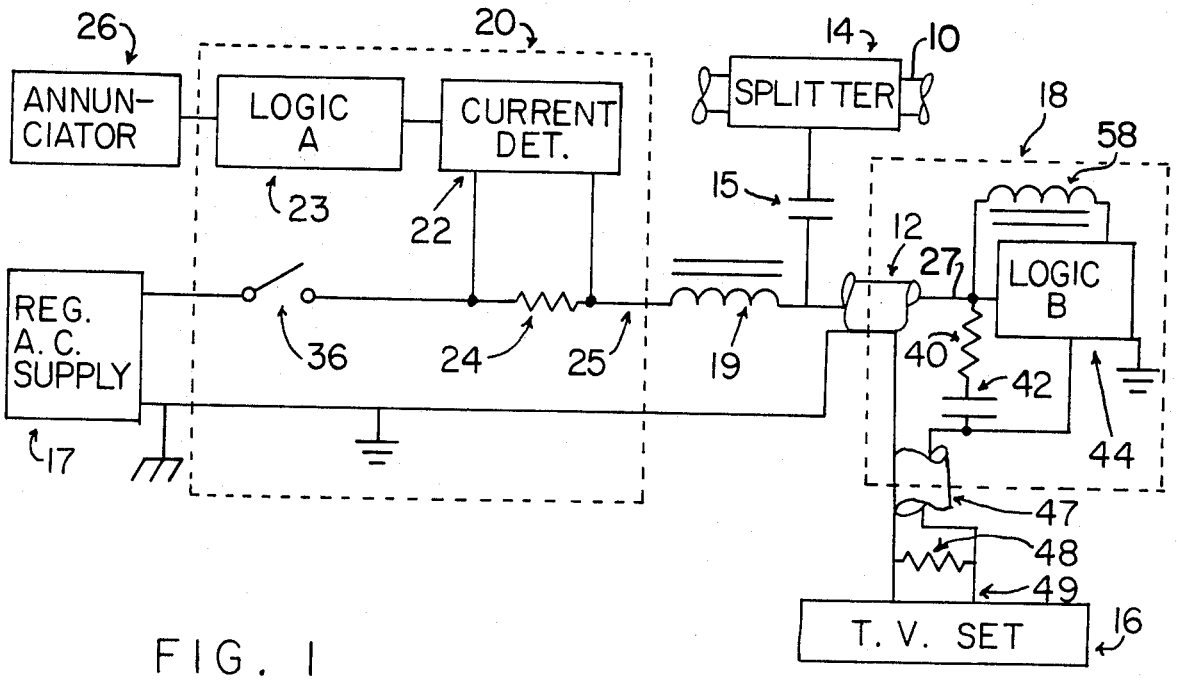
FIG. 1 diagrammatically illustrates a preferred embodiment of the invention.

Master antenna television systems (commonly referred to as MATV systems) are frequently installed in locations wherein a plurality of television sets receive signals from a single antenna. For example, MATV systems are commonly installed in hospitals, motels and apartment complexes. Referring to FIG. 1 of the drawings, an exemplary MATV system would include a main cable 10 which would be connected to an antenna and main amplifier (neither of which are shown). A plurality of trunk lines, such as trunk line 12 of FIG. 1 are each connected to the main cable by a splitter 14 which is powered by the head end amplifier. The purpose of the head end amplifier is to amplify the signal appearing on the main cable 10 and provide a desired signal strength along each trunk line 12. Each of the trunk lines is in turn connected to a plurality of television sets 16 by directional tap 18 (only one of which is shown). The number of television sets connected to a particular trunk line is such that adequate signals will be received by each set, but will usually not exceed 15.

In accordance with the principles of the present invention, each of the trunk lines 12 of a MATV system is connected to an associated central monitor unit 20 located at a central point in the system, such as the manager's office of a motel.

As is also illustrated in FIG. 1 of the drawings, each of the central monitor units 20 includes a current detector 22 which is responsive to the flow of current through a resistor 24 connected in line 25 connected to the main conductor 27 of the trunk line 12. The output of the current detector 22 is applied to a logic circuit A, indicated by the reference numeral 23. The output of the logic circuit A of each of the central monitor units is applied to the input of a common annunciator 26.

Figure 2:
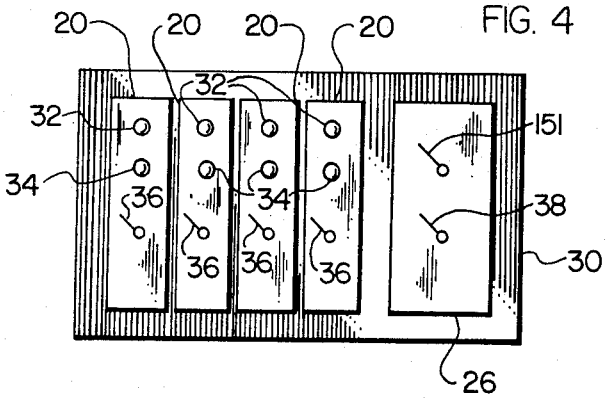
FIG. 2 is a front elevational view illustrating a control panel in accordance with the present invention.

An exemplary installation at the central point is shown in FIG. 2 of the drawings wherein there is provided a cabinet 30 which houses the annunciator 26 and a plurality of central monitor units 20. Each of the central monitor units 20 include a lamp 32 for indicating that a television set on that particular trunk line has been disturbed and a reset switch 36. A lamp 34 can be provided for indicating that the associated trunk line has been cut. The annunciator 26 also includes a reset switch 38.

Referring again to FIG. 1 of the drawings, the splitter 14 is coupled to the trunk line 12 by a capacitor 15 which isolates the splitter from the low frequency, 60 Hz supply voltage provided by a regulated AC supply 17, but provides a low impedence path for television signals from the splitter to the trunk line. An inductor 19 is preferably provided between the connection of a splitter to a trunk line and the central point in the system for the purpose of isolating the central monitor units and regulated AC supply from the high frequency television or radio frequency signals. An AC termination is provided at the end of each trunk line by connecting a capacitor in series with the conventional 75 ohm resistor, neither of which are shown.

As indicated previously, a plurality of directional taps 18 will normally be connected to each of the trunk lines 12 although only one such tap is shown in FIG. 1 for purposes of simplicity. Each directional tap 18 includes resistor 40 and capacitor 42 conventionally used in such taps for coupling a television set to the tap through coaxial line 47. In accordance with the present invention, directional tap 18 also includes a logic circuit B, designated by the reference character 44, and a buzzer coil 58 for providing an audible alarm at the location of the TV.

It is considered desirable that an audible alarm be sounded at the location of the tap 18. The presence of the audible sound at that location will aid in locating a set which has been disturbed or a tap at which a malfunction has occurred. It also permits an innocent person to call the office for the purpose of explaining an occurrence creating an alarm and requesting that the alarm be stopped. If, on the other hand, a theft has been initiated, the presence of the audible warning will in many instances prevent direct, unexpected confrontation between the thief and personnel of the owners of the system. By connecting the buzzer directly to the walls of the room in which the TV set is located, the effect of the buzzer is amplified, creating a much more desirable effect than if merely a non-buzzer audible device were provided. However, in the event it is desired not to inform the person who has tampered with the TV set that the tampering has been sensed, the buzzer can be replaced with a load resistor.

In accordance with the preferred embodiment of the invention, tampering with the TV set is detected by means of cooperation of logic circuit B, reference character 44, with a resistor 48 which is connected between the signal carrying conductor 49 of cable 47 and a point of common potential or ground. The logic circuit 44 detects any change in the resistance between the conductor and ground, and initiates an alarm signal in response to such change.

Figure 3:
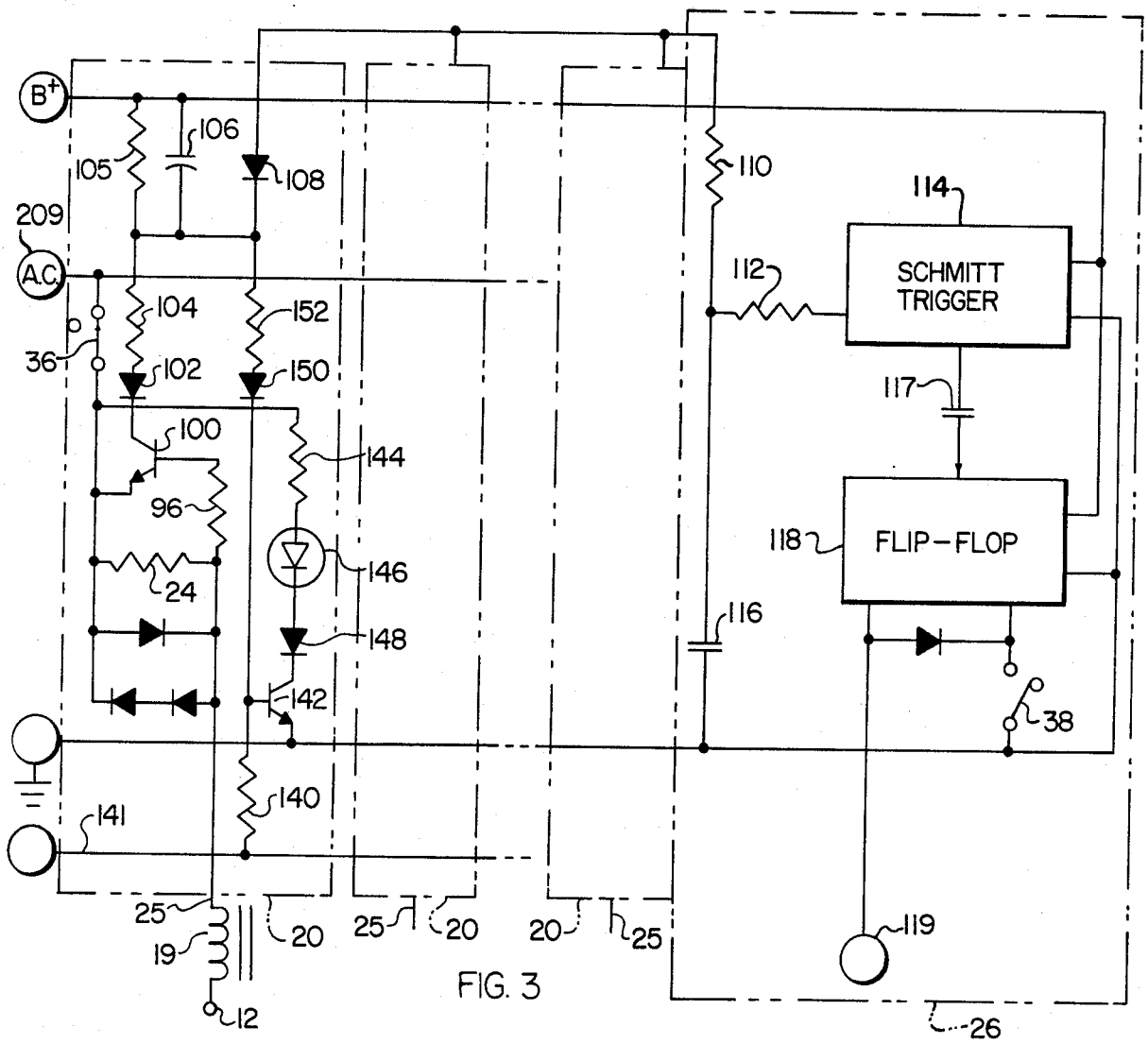
FIG. 3 is a schematic diagram, partially in block diagram form, illustrating the electrical connections within the control panel.

Referring now to FIG. 3 of the drawings, as previously indicated with respect to FIG. 2 of the drawings, a separate central monitor unit 20 is associated with each trunk line 12. Each trunk line is connected to the source 17 of AC voltage through an associated inductor 19, line 25, current sensing resistor 24 and reset switch 36. When the switch 36 is operated to the reset position, the supply of AC voltage through the trunk line 12 to the directional tap 18 will be interrupted, causing the buzzer to stop sounding. When the reset switch 36 is returned to the normal on position, if the conditions on the TV set initiating the alarm are normal, the buzzer will no longer be actuated.

It will be noted that the resistor 24 is connected in series with resistor 96 across the base to emitter circuit of transistor 100. The collector of transistor 100 is connected through the diode 102 and resistors 104 and 105 to a source of B+ potential. When circuitry in a tap 18 connected to the trunk line senses an alarm condition, permitting current to flow through the coil 58 of the buzzer, the current flowing through the buzzer will also flow through the current sensing resistor 24, which suitably has a relatively low value of resistance such as 10 ohms. Thus, in accordance with the preferred embodiment of the invention, the normal 60 Hz current from the directional taps on a trunk line will only be a few milliamperes, and will be present mainly on the positive peaks of the AC waveform.

When one of the directional taps indicates an alarm condition, the current on both the positive and negative peaks will exceed 100 milliamperes and the voltage drop across the resistor 24 will be sufficient to bias the transistor 100 into conduction during the negative peaks of the AC voltage which in accordance with the preferred embodiment of the invention is approximately −32 volts. Transistor 100 will be saturated during the negative peaks causing capacitor 106 which is connected across the resistor 105 to charge to approximately 42 volts. The negative potential appearing on the capacitor 106 is applied through an isolating diode 108 and resistors 110 and 112 to the input of a Schmitt Trigger circuit 114.

Triggering of the Schmitt Trigger 114 by the charge on the capacitor 106 is delayed by capacitor 116 which is connected between electrical ground and the junction of resistors 110 and 112 to prevent triggering of the Schmitt Trigger by voltage transients. When the Schmitt Trigger 114 is triggered, it provides a negative going output voltage which is coupled through capacitor 117 to set a latching flip-flop circuit 118. The flip-flop circuit 118 provides an output voltage to an audible alarm 119, associated with the annunciator 26. The audible alarm in the office can be removed by operating reset switch 38 to the Test position, resetting the flip-flop 118. It will be noted that once the annunciator has been reset, the audible alarm will not be actuated as a result of a new alarm condition until the initial alarm condition has been corrected.

Figure 4:
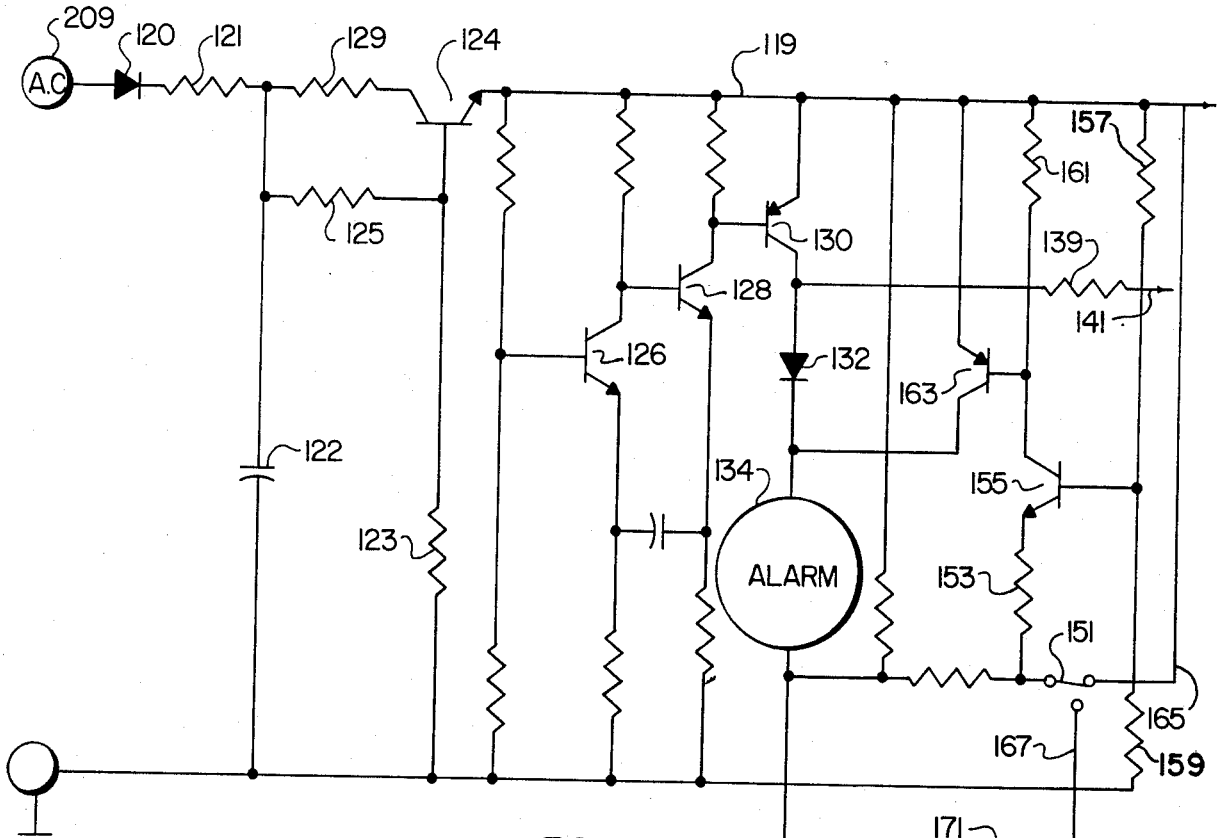
FIG. 4 is a schematic diagram of a preferred alarm circuit.

A preferred alarm circuit 119 for incorporation into the annunciator 26 is shown in FIG. 4 of the drawings. The alarm circuit receives power from a 24 volt AC supply voltage 209 which is rectified by rectifier 120 and regulated by the circuit comprising capacitor 122, transistor 124, and resistors 123, 125 and 129 to provide a B+ supply voltage, suitably +12 volts.

The regulated DC output of the transistor 124 is applied to a flasher oscillator circuit comprising transistors 126 and 128 with associated resistors and capacitors which will not be described in detail as the oscillator is not considered unique in itself. The collector of transistor 128 of the flasher oscillator is connected to the base of a transistor 130 whose emitter is connected to B+ potential. The collector of transistor 130 is connected through diode 132 and an audible warning device 134, such as a device sold under the trademark Sonalert, to the output of the flip-flop 118. When the flip-flop 118 is in the set condition, the output will be at ground potential permitting current to flow through the emitter-collector circuit of transistor 130, diode 132 and the audible device 134 when transistor 128 of the oscillator circuit is biased on. The annunciator 26 will therefore provide an intermittent audible alarm at the frequency of the flasher oscillator.

Whenever the transistor 130 is rendered conductive, its collector will rise to near B+ potential. The collector of transistor 130 is connected through resistor 139 and line 141 to each of the central monitor units 20. This output from the alarm circuit is utilized to cause flashing of the indicator lamp 32 during an alarm condition as will be described in greater detail.

Referring momentarily to FIG. 3 of the drawings, line 141 is connected, within each of the central monitor units 20, through a resistor 140 to the base of a transistor 142. The regulated AC supply voltage is connected through the reset switch 36, resistor 144, a light emitting diode 146, diode 148, and the collector-emitter circuit of transistor 142 to ground or common potential. Transistor 142 will be continuously in conduction, causing the light emitting diode 146 to emit light continuously, indicating that the particular trunk system is operative and not in an alarm condition.

In the event an alarm condition exists on a particular trunk line, capacitor 106 of the central monitor unit 20 associated with that particular trunk line will be charged to a negative voltage, biasing the transistor 142 off except when a positive potential is applied along line 141 from the collector of transistor 130 in the alarm circuit (FIG. 4). It can therefore be seen that operation of the flasher oscillator will have no effect on the light emitting diode of any central monitor unit except one which is associated with a trunk line which is in the alarm condition. If an alarm is present on the associated trunk line, the light emitting diode within the associated central monitor unit will flash, indicating the particular trunk line on which an alarm has been initiated.

The alarm circuit also includes provision for initiating an audible alarm at a remote or external location by use of a switch 151. The armature of switch 151 is connected through resistor 153 to the emitter of transistor 155. The base of transistor 155 is connected to the output of a voltage divider comprising resistor 157 and 159 connected between B+ and ground potential. The collector of transistor 155 is connected through resistor 161 to B+ and to the base of transistor 163.

When the armature of switch 151 is connected to a line 165, transistors 155 and 163 will be biased off. However, when it is connected to line 167 the emitter of transistor 155 will be connected to ground potential through external alarm 169 after a time delay imposed by delay 171, causing the transistor to conduct. The flow of current through transistor 163 will be continuous, producing a steady audible alarm.

As shown in FIG. 2 of the drawings, a supervised system is desirable, and an indicator 34 can be provided for the purpose of indicating if the trunk line itself has become cut. Positive peaks can be detected to indicate trunk circuit continuity. This can suitably be accomplished by provision of a diode and resistor in series at the end of a trunk line termination point. If the flow of current in the trunk line should cease, the absence of positive pulses across resistor 24 could be detected using conventional circuitry, indicating that the line hs been cut or disconnected and causing a supervisory alarm. The trunk line can thereby not be cut as a means of disarming the system.

The directional tap 18, as mentioned previously, suitably includes, in addition to the conventional resistor 40 and capacitor 42 used for coupling the trunk line 12 to the TV set 16, a logic circuit 44 which, when actuated, causes a buzzer 58 to sound in the room. Also, in accordance with the present invention a resistor 48 is connected between the signal carrying line and ground. The resistor 48 can be part of the television set circuitry and may be installed in a tamper-proof adapter which will be described in greater detail with reference to FIG. 7 of the drawings, for purposes of use of the system with existing television sets.

Figure 6:
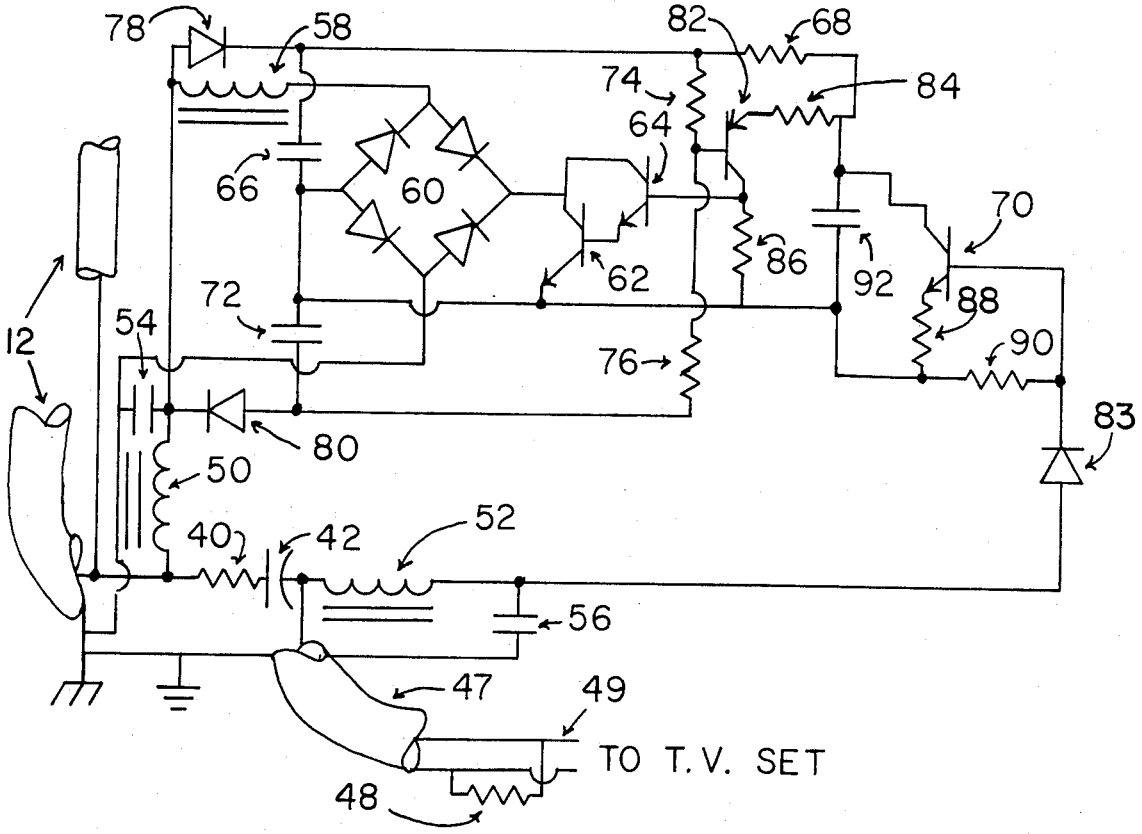
FIG. 6 is a schematic diagram of preferred circuitry provided at a directional tap through which a television set is connected to a master antenna television system trunk line.

Referring to FIG. 6 of the drawings, a preferred embodiment of a directional tap in accordance with the present invention is disclosed. As mentioned with respect to FIG. 1 of the drawings, the trunk line 12 is connected through a resistor 40 and a capacitor 42 to a TV set by cable connector 47, with a resistor 48 being connected across the signal carrying conductor and ground. Power for the electronic system in the directional tap is derived from the regulated AC supply 17 connected to the trunk line at the general location of the central monitor unit 20. The TV signals are isolated from the electronics of the tap 18 by inductors 50 and 52 acting in cooperation with capacitors 54 and 56. The low voltage 60 Hz power passes through the inductor 50, coil 58 of a buzzer and thence through a full wave bridge rectifier 60 to ground. The output of the bridge rectifier is connected through the collector-emitter circuit of the transistor 62 which is part of a Darlington pair including the transistor 64. The emitter of transistor 62 is connected through capacitor 66 and resistor 68 to the collector of a transistor 70. The emitter of transistor 62 is also connected through capacitor 72 to a voltage divider comprising resistors 74 and 76 with the other end of the voltage divider connected to the junction between capacitor 66 and resistor 68. The junction between resistors 68 and 74 is connected to the cathode of a diode 78 whose anode is connected to the junction between inductor 50 and the buzzer coil 58. Similarly, the junction between the capacitor 72 and the resistor 76 is connected to the anode of a diode 80 whose cathode is connected to the junction of the inductor 50 and the buzzer coil 58. The junction between the resistors 74 and 76 is connected to the base of a transistor 82 whose emitter is connected through resistor 84 to the resistor 68. The junction between resistors 68 and 84 is connected to the collector of transistor 70. The collector of transistor 82 is connected through resistor 86 to the emitter of transistor 62 and through resistors 86 and 88 to the emitter of transistor 70 and through resistors 86 and 90 to the base of transistor 70. A capacitor 92 is connected in series wit the resistor 88 across the emitter-collector circuit of the transistor 70.

Capacitor 92 normally has no charge thereon because both sides of the capacitor will go negative during negative half cycles of the applied AC supply voltage. The resistor 48 provides a positive bias on the base of transistor 70 through inductor 52 and diode 83 during negative half cycles of the applied AC supply voltage, permitting the capacitor 92 to be discharged through the emitter-collector circuit of the transistor 70 during the negative half cycles. Capacitor 66 is charged through diode 78 during positive half cycles, providing a positive charging current for capacitor 92 through resistor 68. Since capacitor 92 is not charged during negative half cycles, transistor 82 will not be conductive during negative half cycles causing transistors 62 and 64 to also be non-conductive, preventing flow of current through the buzzer.

When the conductor 49 leading to the TV set is shorted to ground, or if the value of resistance between the conductor 49 and ground is less than approximately 300 ohms, excessive current will flow into the base of transistor 70 during negative half cycles, causing the transistor 70 to saturate and charge capacitor 92. When capacitor 92 contains sufficient charge to cause transistors 82 to conduct, transistor 64 and 62 will also conduct and short out the bridge rectifier 60. When transistors 62 and 64 are conducting, the emitter of transistor 62 will be at or near ground potential and the 24 volt AC supply voltage will be applied to the buzzer coil 58, sounding an alarm within the room. Capacitor 72 will also be charged to the peak negative voltage, this potential being applied through resistor 76 to hold transistor 82 in the conductive state. The base of transistor 70 will be held near ground potential, preventing it becoming conductive. Since transistor 70 is maintained in a non-conductive state, capacitor 92 will remain charged and the circuit cannot be returned to normal by any further action on the TV set cable 47.

If the cable to the television set is cut or removed, positive bias on the base of transistor 70 will no longer exist during negative half cycles of the applied AC supply voltage. Capacitor 92 will then charge positively until transistor 82 commences to conduct, rendering transistors 62 and 64 conductive. Once transistors 62 and 64 commence conducting, the alarm condition is established as described above, with the buzzer sounding continuously.

Once an alarm condition has been established either as a result of a low resistance condition between the conductor 49 and ground or as a result of an open circuit between the conductor 49 and ground, the only way to restore the non-alarm status is to turn off the AC supply voltage provided from the trunk until capacitors 72 and 92 have discharged. If the AC supply voltage is restored with the capacitors 72 and 92 discharged, and the proper resistance is provided between the conductor and ground, transistor 70 will prevent the charging of capacitor 92 as described above. If the proper resistance is not present between conductor 49 and ground, the circuit will return to the alarm condition.

It will be apparent from the foregoing that an important feature of the invention is the use of trunk lines not only to provide TV signals to television sets connected to the trunk line, but also to provide a path for the flow of low frequency AC current through the trunk line which does not interfere with the operation of the television sets connected to the trunk line. Operation of the system is dependent upon detection of changes in the low frequency AC current flowing through the trunk lines, both for the purpose of detecting an alarm condition in which a television set is disturbed and for detecting a condition in which the trunk line is cut. It will be noted that shorting of the trunk line will produce an alarm condition at the central monitor unit in the same manner as would occur if the current was flowing through the coil 58 of a buzzer associated with a particualr TV set connected to it.

Figure 5:
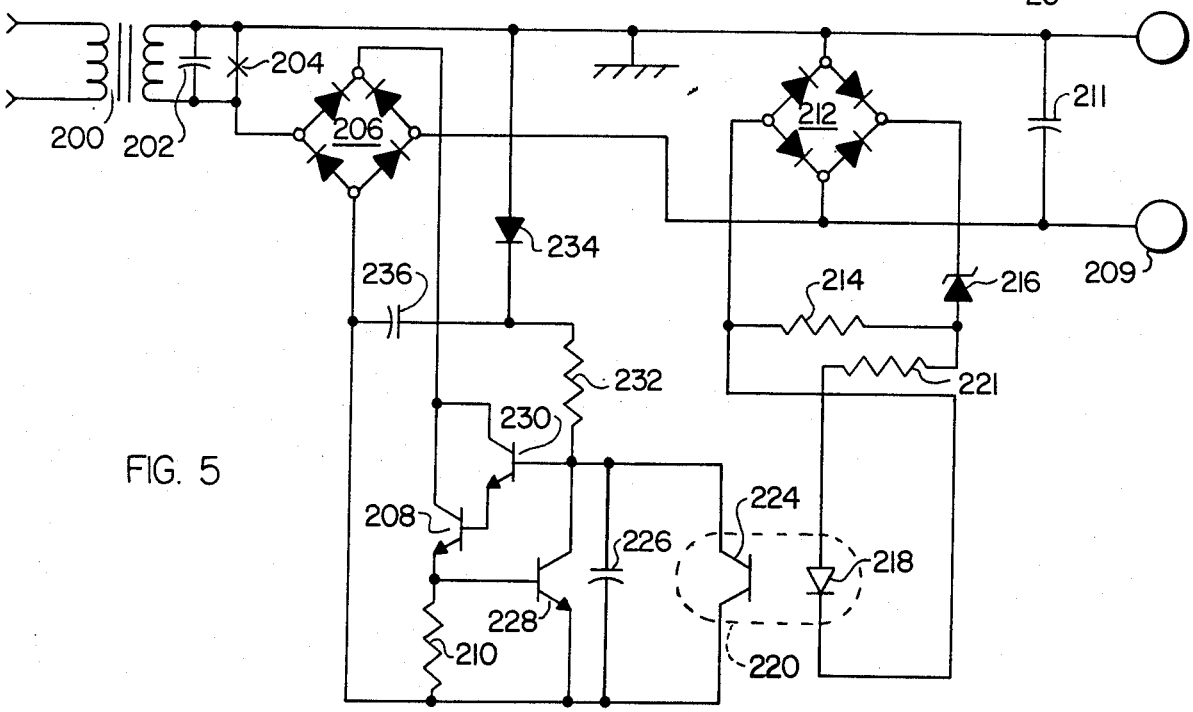
FIG. 5 is a schematic diagram of a preferred type of regulated AC power supply.

Referring to FIG. 5 of the drawings, the preferred circuit for providing a regulated AC supply 17 includes a step down transformer 200 whose primary is connected to a source of available supply voltage such as 115 volts, 60 Hz, and whose output is preferably 24 volts at 3 amperes. This amount of power will be sufficient to supply power to most MATV systems as the power requirements are extremely small except during alarm conditions. Capacitor 202 and varistor 204 are connected across the output of the secondary winding of the transformer 200 to provide transient protection. One side of the secondary winding is connected to the point of common potential, with the other side of the secondary winding being connected to one input node of a full wave rectifying bridge 206. The other input node of the full wave rectifier 206 is connected to the output terminal 209 of the supply circuit. The output nodes of the full wave rectifier 206 are connected in series through the collector-emitter circuit of transistor 208 and resistor 210.

Input nodes of a second full wave bridge 212 are connected between the point of common potential and the output terminal 209 with the output nodes of the bridge 212 being connected in series with a voltage dropping resistor 214 and a zener diode 216. The outputs of the full wave bridge 212 are also connected across a light emitting diode 218 of an opto-isolator 220 through a series circuit comprising resistor 221 and the zener diode 216. When the output of the full wave bridge 212 exceeds the voltage of the zener diode 216, the zener diode will conduct and permit current to flow through the light emitting diode 218, causing conduction of the phototransistor 224. A capacitor 226 and the collector-emitter circuit of a transistor 228 are each connected in shunt across the collector-emitter circuit of the phototransistor 224 of the opto-isolator 220. Resistor 210 is connected across the base emitter circuit of transistor 228 with the collector of transistor 228 being connected to the base of transistor 230 and through resistor 232 and diode 234 to point of common potential. A capacitor 236 is connected in shunt with resistor 232 and the collector-emitter circuit of transistor 228. Transistors 208 and 230 are connected to form a Darlington circuit with low current drive on the base of transistor 230.

In operation of the circuit, it can be seen that current flowing from the output terminal 209 to the trunk lines must flow through transistor 208 and resistor 210. If the output current exceeds a desired level, for example 1.5 amperes, the voltage across resistor 210 will bias transistor 228 to increase its conductivity. As the conductivity of transistor 228 is increased, the conductivity of transistors 230 and 208 will be decreased, limiting the amount of current which can flow through the output terminal 209. The preferred regulated AC supply circuit thereby provides current limitation, preventing destruction of the trunk circuits due to a shorted cable or other factors which could cause excessive current flow.

When the output of full wave rectifier 212 exceeds the zener voltage of diode 216, the zener diode 216 will conduct, causing current to flow through the light emitting diode 218 of the opto-isolator 220. The phototransistor 224 of the opto-isolator will become conductive with the amount of conduction being a function of the extent to which the voltage of the full wave bridge 212 exceeds the zener voltage of the zener diode 216. An increase in the conductivity state of the phototransistor 224 will result in a decrease in the conductivity level of transistor 208, effectively limiting the output voltage of the regulated voltage supply circuit. It can therefore readily be seen that utilization of the AC supply circuit described with reference to FIG. 5 of the drawings will prevent damage to other components of the system caused by changes in line voltage or excessive current flow.

With respect to FIG. 1 of the drawings, and in accordance with the preferred embodiment of the invention especially adapted for detection of thefts of television sets, a resistor 48 is connected across the signal input to the TV set. It is preferable that this resistor be built into the television set at the time the television set is produced. However, prior to the present invention there was no necessity for provision of such a resistor, and there are many television sets installed onto MATV systems which are not provided with such a resistor.

Figure 7:
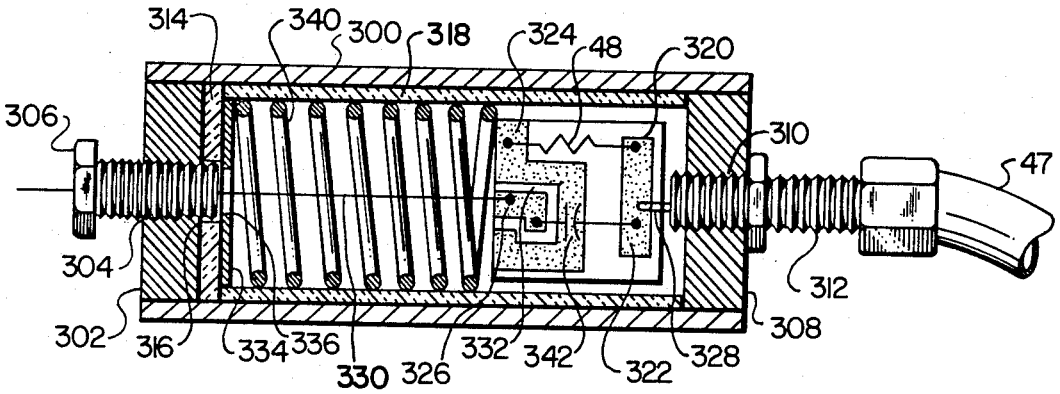
FIG. 7 is a view in cross-section illustrating a preferred type of adapter for connecting a television set to the directional tap in accordance with one embodiment of the present invention.

There is illustrated in FIG. 7 of the drawings a tamper-proof adapter useful for the purpose of connecting a television set to a trunk line of a MATV system with provision for the desired resistor.

Referring now to FIG. 7 of the drawings, the adapter in accordance with the preferred embodiment of the invention includes a cylindrical case 300 formed of an electrically conductive material. A bushing 302 which is also of conductive metal is press fitted into one end of the cylindrical case 300. The bushing 302 includes a centrally located threaded hole 304 for receiving a connector 306 which is suitably the F61 connector normally provided on television sets for connection to MATV systems. A second bushing 308 is press fitted into the opposite end of the cylindrical tube 300, and similarly is provided with a threaded hole 310 for receiving a connector 312, which is also suitably an F61 connector, with the connector 312 being connected to the cable 47 used for connecting the television set to the tap 18 (FIG. 1). An annular plate 314 of insulating material is positioned within the tube 300 adjacent the bushing 302. The opening 316 in the annular insulating plate 314 is of greater diameter than the portion of the connector 306 which is screwed into the bushing 302, and sufficiently thin that the body of the connector will extend through the hole 316. A cylinder 318 which is also of insulating material is provided within the case 300 and extends between the bushing 308 and the annular insulating plate 314.

A printed circuit board 320 is positioned within the insulating cylinder 318. The interior surface of the insulating cylinder 318 can be provided with grooves, not shown, for receiving the printed circuit board 320. The printed circuit board 320 is provided with three discrete metalized areas 322, 324 and 326. The metalized area 322 extends generally along the right hand side of the printed circuit board, as viewed in FIG. 7, and the conductor 328 of connector 312 is mechanically and electrically connected to the metalized area 322. The metalized area 326 is of relatively limited dimension, and centrally located along the left hand side of the printed circuit board as viewed in FIG. 7. A conductor 330 adapted to be received by connector 306 extends from the metalized area 326. The metalized area 324 partially encircles the metalized area 326 and extends to the left edge of the printed circuit board, and preferably across the edge of the printed circuit board, along all but a relatively small center portion reserved for the metalized area 326. A non-metalized zone 332 separates metalized areas 326 and 324. An annular plate 334 of electrically conductive material is provided adjacent the annular insulating plate 314. The opening 336 in the annular plate 334 is sufficiently large to permit the conductor 330 to pass through the hole without contacting the plate 334, but smaller than the hole 316 in the plate 314 such that electrical contact is provided between the plate 334 and the body of the connector 306. A spring 340 contacts the metalized area 324 of the printed circuit board, and is preferably bonded to the metalized area 324 for the purpose of insuring good electrical contact. The opposite end of the spring contacts the plate 334 and biases the plate against the body of the connector 306. The spring 340 acting in cooperation with the plate 334 serves to provide and maintain electrical contact between the plated area 324 of the printed circuit board and the case of connector 306. The resistor 48 is connected between the metalized areas 322 and 324. Capacitor 342 is connected between metalized areas 322 and 326 for providing a low impedence path to high frequency television or radio frequency signals between conductor 328 and conductor 330, but blocking the low frequency AC voltage.

It can be seen from the above description that a low resistance electrical circuit is completed from the center conductor 328 of connector 312 through resistor 48, spring 340, plate 334, and the case of connector 306 to bushing 302. Electrical connection of the resistor 48 between the conductor 328 and the case of connector 306 is required for a safe (non-alarm) condition to exist. The absence of the desired resistance in the circuitry of the directional tap 18 caused either by removal of resistor 48 or shorting of the cable 47 or by removal of the cylinder 300 from the connector 306 will cause an alarm condition. An essentially tamper-proof adaptor is thereby provided.

The preferred embodiment of the invention described herein does not indicate the exact location of a particular television set along a trunk line which has been tampered with. Since only approximately ten or fifteen television sets would, under normal circumstances, to be connected to a single trunk line and each of these sets will be in close proximity, such a system is considered sufficient, particularly in view of the high level of noise created by the buzzer as a result of its connection to the building structure. It will be apparent, however, that a wide range of frequencies is available between the very low frequency of the regulated AC supply voltage and the relatively high frequency of television signals. Accordingly, it would be practical to have an oscillator of a discrete frequency associated with each directional tap 18 and a detector at the central location associated with each directional tap, and which would be responsive to such discrete frequency.

It will also be apparent that the same system could be utilized for signalling other alarm conditions, such as fire or emergency calls for help by providing a switch which would prevent transistor 70 of the directional tap being maintained in the conductive state, thereby permitting the capacitor 92 to become charged and signal an alarm condition created.

Although the principles of the invention have been described with reference to a particular, preferred embodiment thereof, many changes and modifications will become obvious to those skilled in the art in view of the foregoing description which was intended to be illustrative and not limiting of the invention defined in the appended claims.

What we claim is:

1. An alarm system for detecting disturbance of a television set connected by a tap to a trunk line of a MATV system and providing an alarm indication comprising:

a source of voltage of different character than television signals;

means connecting said source to said trunk line;

a resistor connected to provide a desired resistance to the flow of current of said different character between a conductor connecting the TV set to the tap and a point of common potential;

local audible alarm means located at a not readily accessible location in the vicinity of but external to the TV set;

detector means responsive to a change in the resistance between said conductor and said point of common potential for causing current of said different character to flow in said trunk line from said voltage source and pass through said local audible alarm means to sound an audible alarm;

central alarm means positioned at a central control location remote from said television set location for providing an alarm indication during an alarm condition on said trunk line; and current detecting means coupled to said connecting means for sensing a change in the level of current of different character flowing through said connecting means caused by current flowing through said local audible alarm means, said current detecting means applying a signal defining an alarm condition to cause said central alarm means to provide said alarm indication responsive to a change in current level being sensed.

2. An alarm system as defined in claim 1 wherein said central alarm means provides one visual indication during an alarm condition and a different visual indication when an alarm condition does not exist on said trunk line.

3. An alarm system as defined in claim 1 wherein said central alarm means provides an audible alarm at said central location responsive to said current detecting means detecting an alarm condition.

4. An alarm system as defined in claim 1 wherein said audible alarm means is a buzzer and said change of current is produced as a result of current of said selected frequency flowing through the buzzer.

5. An alarm system as defined in claim 1 wherein said source of voltage is regulated to prevent either current or voltage in excess of a selected level being applied to said trunk line.

6. An alarm system as defined in claim 1 wherein said resistor is physically positioned within said TV set.

7. An alarm system as defined in claim 1 wherein said resistor is positioned within an adapter means for connecting said TV set to said tap, said adapter means being constructed and arranged to produce a change in the resistance between said conductor and said point of common potential sufficient to be detected by said detector means responsive to disassembly of said adapter or disconnection of said adapter.

8. An alarm system as defined in claim 1 further including a reset switch effective when operated to the reset position for interrupting the flow of current from said source of voltage through said trunk line.

9. An alarm system as defined in claim 1 wherein said detector means comprises a capacitor, means responsive to the resistance between said conductor and said point of common potential for preventing charging of said capacitor when said resistance is within a selected range and for permitting charging of said capacitor when said resistance is not within said selected range, and circuit means responsive to said capacitor being charged for permitting current of said selected frequency to flow in said trunk line and through said audible alarm means of sufficient magnitude to actuate said audible alarm means.

10. An alarm system as defined in claim 9 wherein said circuit means responsive to said capacitor being charged prevents discharge of said capacitor except on interruption of the flow of current of said selected frequency through said trunk line.

11. An alarm system as defined in claim 10 further including reset switch means positioned remotely from said tap and effective when operated to the reset position to interrupt the flow of current of said selected frequency through said trunk line.

12. An alarm system as defined in claim 1 further including filter means for isolating said TV set from said voltage of selected frequency and for isolating elements of said alarm system from signals of television or radio frequency normally present on said trunk line.

13. An alarm system as defined in claim 1 wherein said audible alarm means is located at said tap.

* * * * *